United States Patent [19]

Winthaegen et al.

[11] Patent Number: 4,657,373

[45] Date of Patent: Apr. 14, 1987

[54] ELECTROPHOTOGRAPHIC COPYING DEVICE WITH MEANS TO EFFECT UNIFORM AGING OF PHOTOCONDUCTIVE ELEMENT

[75] Inventors: Leon M. W. Winthaegen, Maasbree; Georgius H. Schipper, Meerlo, both of Netherlands

[73] Assignee: Oce-Nederland B.V., Venlo, Netherlands

[21] Appl. No.: 755,949

[22] Filed: Jul. 12, 1985

[30] Foreign Application Priority Data

Jul. 25, 1984 [NL] Netherlands ..... 8402339

[51] Int. Cl.[4] ..... G03G 21/00

[52] U.S. Cl. ..... 355/3 R; 355/3 TR; 355/30

[58] Field of Search ..... 355/3 R, 3 TR, 3 BE, 355/16, 30

[56] References Cited

U.S. PATENT DOCUMENTS 3,893,761 7/1975 Buchan et al. ..... 355/3 TR 3,923,392 12/1975 Buchan et al. ..... 355/3 TR

*Primary Examiner*—R. L. Moses

*Attorney, Agent, or Firm*—Reed Smith Shaw & McClay

[57] ABSTRACT

Electrophotographic copying device provided with an endless photoconductive element, means for forming a powder image on the element and an intermediate support which, under the influence of pressure, is capable of picking up the powder image from the element and then under the influence of pressure and heat, transferring the image to and to fixing it on a copy sheet. Further, the device is provided with cooling means, e.g., blower slots, for cooling that portion of the surface of the intermediate support which has not been in contact with the copy sheet.

4 Claims, 3 Drawing Figures

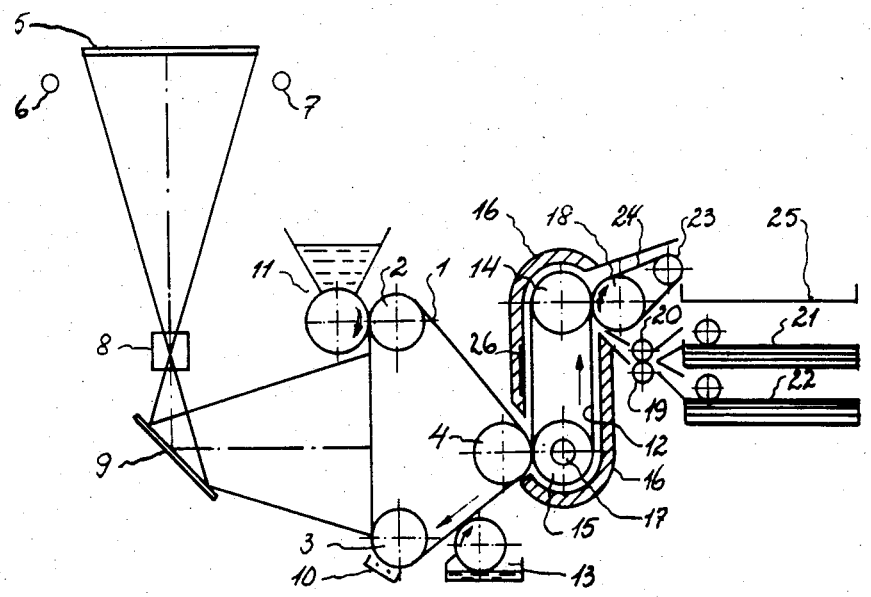
FIG. 1
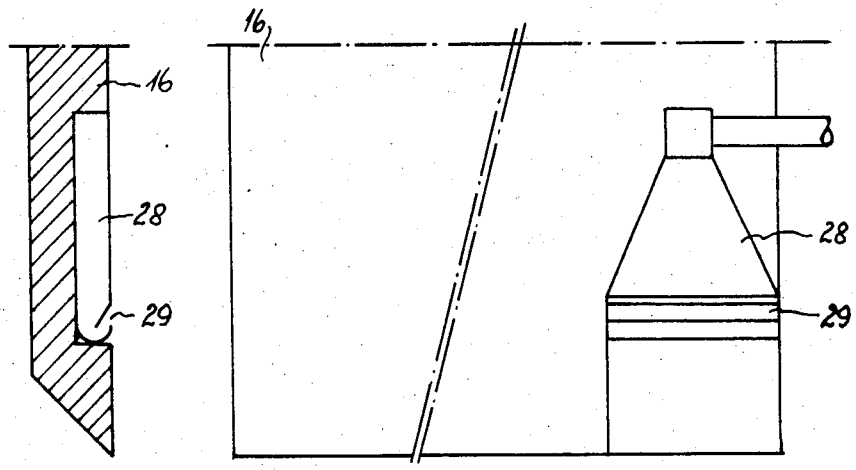
FIG. 2B
FIG. 2A

ELECTROPHOTOGRAPHIC COPYING DEVICE WITH MEANS TO EFFECT UNIFORM AGING OF PHOTOCONDUCTIVE ELEMENT

FIELD OF THE INVENTION

The present invention relates to an electrophotographic copying device, and, in particular, to an electrophotographic copier in which cooling means is provided to reduce the nonuniformity of aging caused by differing paper sizes used for the copies.

BACKGROUND OF THE INVENTION

The invention relates to an electrophotographic copier having an endless photoconductive element and an endless intermediate support which moves in synchronization with the element and under pressure accepts the powder image from the element and transfers and fixes it to the paper. Such devices are well known in the art, for example, see U.S. Pat. Nos. 4,455,079; 4,439,462 and United Kingdom Patent Application No. 2 040 226 A. Each of these electrophotographic devices transfer the electrostatically formed toner image from the photoconductor to an intermediate support at a first zone to paper at a second zone. In these devices the intermediate support is heated to melt or render tacky the toner for application on the paper to receive the toner image.

One of the troublesome problems with this method of copy transfer is that the heated intermediate support causes the photoconductor to age more quickly. In United Kingdom Patent Application No. 2 040 226 A a cooling means is used to cool the intermediate support on its travel from the second zone back to the first zone. Similarly, U.S. Pat. No. 4,455,079 uses a cooling roll to achieve the same cooling of the intermediate support through heat conductive elements.

In such devices it is possible in practice to make good quality copies over a long period if it is designed to produce copies of one single size. In such a case the photoconductive element is always loaded uniformly over a strip having the same width as that size, which means that the unavoidable aging of that strip takes place gradually and uniformly.

To compensate for the influence of such aging it is well known to regulate the intensity of the image-wise exposure or the electrostatic charging of the photoconductive element in relation to the number of copies that have been produced using the element. In the known devices, the intermediate support is cooled after leaving the second zone, based on the idea that the aging of the photoconductive element is to a large extent caused by heat transfer from the intermediate support to the element in the first zone and that the aging is more serious the higher surface temperature of the intermediate support is when it reaches the first zone.

However, if a copier of the type described above is suitable for making copies of mutually differing dimensions, the photoconductive element and the intermediate support will, when copies of the one size are being produced, be loaded in a different part than when copies of another size are being produced. As a result of such an uneven load, the photoconductive element will show uneven aging on its surface. This is particularly true when, as is often the case in practice, the device is predominantly used for producing copies of a small size (e.g., A4), to a lesser extent for copies of a slightly bigger size (e.g., A3) and only for a few copies of an even bigger size (e.g., A2). The resultant unevenness in aging becomes visible on the larger copies in the form of unacceptable, differently tinted strips in the background.

This unevenness cannot be postponed or its effects compensated for by applying the cooling measures referred to in the known devices, because they are applicable to the case of uniform aging.

The cause of said unevenness is attributable to a number of factors. For instance, the surface portions of the intermediate support which come into contact with a copy sheet in the second zone transfer heat to the sheet and, therefore, upon leaving the second zone they will be cooler than surface portions which have not come into contact with the sheet. If the intermediate support, having such a temperature pattern on its surface, comes into contact with the photoconductive element in the first zone, the element will be subjected to an uneven heat load. In addition, the surface portions of the intermediate support which come into contact with copy sheets will transfer more paper dust and image powder remnants to the photoconductive element than those portions which do not make such contact. Consequently, the photoconductive element and the intermediate support become unevenly contaminated.

Partly because of the uneven contamination, the nature of the surface of the more loaded portions of the intermediate support will change slightly (e.g., they will become somewhat rougher). This means that in the first zone, the frictional load upon the photoconductive element will be different from that brought to bear by less loaded portions.

Accordingly, the known systems and devices do not attempt to reduce or eliminate the nonuniform aging of the phtoconductor which shows up on the larger copies in multi-sized copiers.

SUMMARY OF THE INVENTION

Generally, the present invention provides means for minimizing or eliminating the uneven aging of the photoconductor element caused by heat and contaminates in electrophotographic copiers adapted to handle a plurality of different sized copies. The means for eliminating the uneven aging comprises a cooling means positioned between the second and first zones adjacent to the intermediate support. The cooling means of the present invention is designed to cool that surface portion of the intermediate support that was not in contact with the copy sheet in the second zone.

Although it could be expected that this measure would enable the consequences of an unevenness in the heat load on the photoconductive element to be abated, it was surprisingly found that it also enables the consequences of other types of uneven loads to be compensated for, provided that the intensity of the said cooling is accurately adjusted in line with the prevailing conditions (nature of the photoconductor, toner, intermediate support, etc.). In practice this usually means that the surface portions of the intermediate support which are slightly warmer when they leave the second zone will be cooled to such an extent on their way to the first zone that when they reach the first zone they will be slightly cooler than the other surface portion.

The cooling means of the present invention can be relatively simple; for example, one or more blower slots connected to an air pump, through which cooling air can be blown on to the intermediate support and which can be activated depending on the dimensions of the copy sheet being used.

Other advantages of the present invention will become apparent from a perusal of the following detailed description of a presently preferred embodiment taken in connection with the accompanying drawings.

BRIEF DESCRIPTION OF THE DRAWINGS

FIG. 1 represents a diagrammatic cross-section of a copying machine in which the cooling means according to the invention is used.

FIGS. 2A and B are an enlarged diagrammatic front view and cross-sectional view of the cooling means according to FIG. 1, respectively.

PRESENTLY PREFERRED EMBODIMENT OF THE INVENTION

The device depicted in FIG. 1 is provided with an endless photoconductive belt 1 which is moved at a uniform speed with the aid of the drive or guide rollers 2, 3 and 4. After belt 1 has been electrostatically charged by corona discharge device 10, the image of an original placed on the platen 5 is projected on to the belt with the aid of flash bulbs 6 and 7, lens 8 and mirror 9.

The latent charge image left behind on belt 1 after the flash exposure is developed with the aid of magnetic brush device 11 to form a powder image. This image is then transferred by pressure in a first pressure zone to an endless intermediate support belt 12. Support belt 12 is made from or coated with a soft, resilient and heat-resistant material, such as silicone rubber. Following the image transfer, any image remanants left on belt 1 are removed with the aid of a cleaning device 13. After cleaning, belt 1 is ready to be used again.

Belt 12 is stretched over drive and guide rollers 14 and 15, respectively, which, together with belt 12, are fitted in a space which is enclosed as much as possible by heat-insulating material 16. This space, and thus belt 12 as well, is heated by one or more heating elements, for example, by an infrared radiator 17 installed inside roller 15. As the powder image adhering to belt 12 is moved along, it is heated in such a way that the image powder becomes sticky. In a second pressure zone the sticky image is then transferred by pressure to and simultaneously fixed on a sheet of paper which has been fed in from one of the sheet reservoirs 21 and 22 via rollers 19 and 20, respectively. Thereafter, the copy thus produced is deposited on to a table 25 by belt 24, which is stretched over rollers 18 and 23.

If sheet reservoirs 21 and 22 have been filled with stacks of paper sheets of differing size, e.g., reservoir 21 with sheets of A4 size ($210\times297$ mm$^2$) and reservoir 22 with sheets of folio size ($210\times330$ mm$^2$), and if the sheets during their processing are fed through the machine placed sideways-on, i.e., with their long edges at right angles to the feed direction, and, as is usual, with their short edges guided up against a fixed stop, then a narrower part of belt 12 will be loaded when a sheet originating from reservoir 21 is pressed against belt 12, than when the sheet originates from reservoir 22. This difference creates the eventual uneven aging of the photoconductor.

The present invention provides a method and means for preventing to the greatest extent possible the uneven aging of photoconductor belt 1. The method provides for cooling the support between the second and first zones in that surface portion that did not contact the paper in the fusing zone as it leaves the second zone. The method can be achieved with a cooling means 26 which cools those portions of the surface of belt 12 which have not been in contact with paper in the second pressure zone.

In FIG. 2, one preferred embodiment of cooling means 26 comprises a flat box 28 which is recessed into insulating wall 16 and which is fitted at one end with a blower slot 29 and at the other end with a pipe connected to an air pump (not shown). Slot 29 has a length which corresponds to the difference between the lengths of the sizes of paper stored in reservoirs 21 and 22. In a particular electrophotographic copier using DIN sized paper the length was about 33 mm in the sizes described above.

The electrophotographic device is further provided with switches (not shown, but known to those skilled in the art), which turns on the air pump when sheets are fed from reservoir 21 and turns it off when sheets are fed from reservoir 22. In this way, each time a sheet is fed from reservoir 21, air is blown through slot 29 on to that portion of the surface of belt 12 which does not come into contact with the sheet. That part is thus cooled by cooling means 26.

It is clear that if an optimum result is to be achieved, the supply of cooling air must be attuned to the operating conditions. It has been found, for instance, that in a practical situation where belts 1 and 12 are driven at a speed of about 30 cm/sec., and where belt 1 is coated with a photoconductive ZnO binder layer and the surface temperature of belt 12 is 160° C. when it reaches the second pressure zone, and where the temperature difference between a part of the belt that comes into contact with copy paper and a part that does not, amounts to $\pm1°$ C. upon leaving the second pressure zone, the consequence of the uneven loading referred to above can be largely or entirely eliminated by dimensioning the capacity of the air pump and the width of blower slot 29 so as to ensure an air flow of about 3.5 m/sec. blowing against the direction of movement of belt 12.

The originally warmer part of the belt is so cooled by this air flow that, when it reaches the first zone, its temperature is about 4° C. lower than that of the other part of the belt. The volume of air that has to be displaced for this purpose is about 4 m$^3$/h, a quantity which is so slight that it has hardly, if any, effect on the copying machine's heat balance or power consumption. Using the method and means of the invention excellent results were obtained. In a device which did not incorporate the cooling means, for example, an uneven aging of a portion of the surface of belt 1 had already become apparent on copies produced using that part after about 1500 loads, whereas when the cooling means of the present invention were implemented, the copies produced revealed no signs of unevenness after about 6000 loads on the same portion of the surface.

In photocopiers described above, two sheets reservoirs are used. It will be clear that the invention is not restricted to this particular embodiment; it can be used to equal advantage in devices with three or more reservoirs and with a number of blower slots which can be activated in pairs or singly. Instead of several blower slots, it is also possible to use one blower slot whose effective length can be varied to bring it into line with the size of the copy paper being used. It will also be clear that the application of the invention is not limited to devices in which precut sheets of paper are processed but that it is also applicable in devices in which web-like copy paper is used.

While a presently preferred embodiment of the invention has been shown and described in particularity, it may be otherwise embodied within the scope of the appended claims.

What is claimed is:

1. In an electrophotographic copying device having a moving, endless photoconductive element, means for forming a powder image on said element by electrostatically charging, image-wise exposing and developing; an endless intermediate support, the movement of which is synchronized with that of said element and which, under the influence of pressure, is able to accept the powder image from said element and thereafter to transfer said image to and fix it on a copy sheet under the influence of pressure and heat; means for pressing the intermediate support against the element in a first zone and against the copy sheet in a second zone; means for heating the intermediate support; and means for moving the copy sheet to the said second zone, the improvement comprising a means for cooling a portion of the surface of said intermediate support when it is moving from said second zone to the first, said surface portion being that which has not been in contact with the copy sheet in the second zone.

2. The improvement according to claim 1, wherein said cooling means comprises at least one blower slot connected to an air pump for blowing cooling air on the intermediate support.

3. The improvement according to claim 2, wherein said cooling means includes means for activating said air pump depending on the dimensions of the copy sheets being used.

4. The improvement according to claim 1, wherein said copying device includes at least two different sizes of copy sheets.

* * * * *